US005161437A

United States Patent [19]

Yasutomi et al.

[11] Patent Number: 5,161,437

[45] Date of Patent: Nov. 10, 1992

[54] DEVICE FOR TIGHTENING UP NUT ON BOLT

[75] Inventors: Sueharu Yasutomi; Shozo Matsumura, both of Osaka, Japan

[73] Assignee: Maeda Metal Industries, Ltd., Osaka, Japan

[21] Appl. No.: 868,671

[22] Filed: Apr. 15, 1992

[30] Foreign Application Priority Data

Apr. 17, 1991 [JP] Japan ..... 3-85144

[51] Int. Cl.[5] ..... B25B 21/00

[52] U.S. Cl. ..... 81/57.14; 81/56; 81/57.3

[58] Field of Search ..... 21/54, 55, 56, 57, 57.11, 21/57.14, 57.22, 57.3, 57.31, 57.32, 57.36; 74/665 L, 665 N

[56] References Cited

U.S. PATENT DOCUMENTS 1,343,667 6/1920 Evensen ..... 81/56

4,403,529 9/1983 Ikeda et al. ..... 81/56

*Primary Examiner*—D. S. Meislin

*Attorney, Agent, or Firm*—Armstrong & Kubovcik

[57] ABSTRACT

A device for tightening up nuts on torque-controlled bolts comprising an inner socket first output gear rotatably disposed within a housing, an outer socket second output gear rotatably disposed coaxially with the first output gear, an inner socket first input gear rotatably disposed on an axis parallel to the axis of the first and second output gears and meshing with the first output gear, and an outer socket second input gear rotatably disposed coaxially with the first input gear and meshing with the second output gear. The first and second output gears respectively have shafts projecting therefrom in the form of concentric circles to provide socket fitting portions at outer ends of the respective shafts. The first and second input gears respectively have shafts projecting therefrom in the form of concentric cir cles to provide coupling portions at outer ends of the respective shafts for connection to output shafts of a power tightening device.

7 Claims, 7 Drawing Sheets

DEVICE FOR TIGHTENING UP NUT ON BOLT

FIELD OF THE INVENTION

The present invention relates to a device for tightening up nuts on torque-controlled bolts (i.e., bolts having a tip to be sheared off when subjected to a predetermined torque).

BACKGROUND OF THE INVENTION

The present applicant has already proposed a device for tightening up nuts on torque-controlled bolts as disclosed in U.S. Pat. No. 4,403,529. This device achieves a high work efficiency but has the drawback of being not usable at locations where a sufficient space is not available for tightening work.

Tightening devices for use with compressed air as a power source are also in use but have the same drawback as above.

FIG. 6 shows a conventional power tightening device, which has two output shafts 17, 18 arranged coaxially and rotatable in opposite directions to each other by a single input shaft 16*a* through a differential reduction mechanism 16. An inner socket fittable to bolt tips is attached to one of the output shafts, 18, and an outer socket fittable to nuts on bolts is attached to the other output shaft 17.

The differential reduction mechanism 16 generally comprises a multiplicity of planetary gear means, therefore has many parts and is complex in construction. Attempts to compact the differential reduction mechanism are greatly restricted from the viewpoint of machining the parts and the strength thereof, consequently imposing limitations on the size of the case for accommodating this mechanism. Furthermore, the power tightening device is not always usable for fastening structural members. For example, when nuts are to be tightened up by the device 1 with its head 19 inserted in the groove 81 of a channel member 8 as seen in FIGS. 6 and 7, the head 19 is too large to insert into the groove 81.

The present invention provides a device of reduced size for tightening up nuts on torquecontrolled bolts to overcome the above problems. The present device comprises a minimized number of components required for the tightening operation and is made usable as coupled to a conventional power tightening device.

The tightening device of the present invention may be constructed as assembled with the conventional power tightening device, or may be used as removably attached to the conventional device only when required.

SUMMARY OF THE INVENTION

The device of the present invention for tightening up nuts on bolts comprises:

an inner socket first output gear rotatably disposed within a housing, an outer socket second output gear rotatably disposed coaxially with the first output gear, an inner socket first input gear rotatably disposed on an axis parallel to the axis of the first and second output gears and meshing with the first output gear, and an outer socket second input gear rotatably disposed coaxially with the first input gear and meshing with the second output gear, the first and second output gears respectively having shafts projecting therefrom in the form of concentric circles to provide socket fitting portions at outer ends of the respective shafts, the first and second input gears respectively having shafts projecting therefrom in the form of concentric circles to provide engaging portions at outer ends of the respective shafts for connection to output shafts of a power tightening device.

DESCRIPTION OF THE PREFERRED EMBODIMENTS

Figure 1:
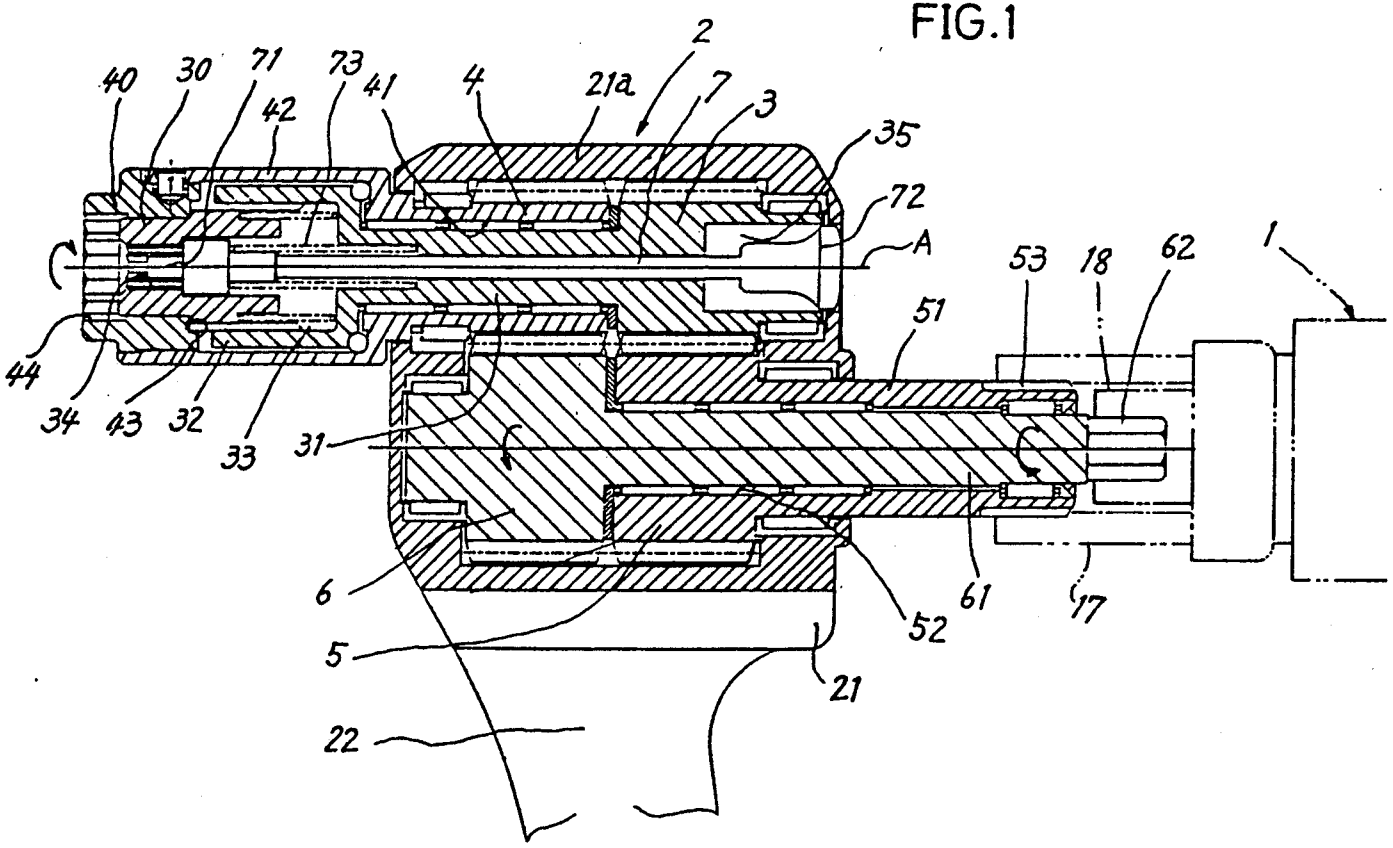
FIG. 1 is a sectional view of a tightening device embodying the invention.

FIG. 1 shows a tightening device 2 of the invention comprising an inner socket output gear 3 and an outer socket output gear 4 which are rotatably disposed on the same axis A within a housing 21.

An inner socket input gear 5 meshing with the output gear 3 and an outer socket input gear 6 meshing with the output gear 4 are rotatably disposed on an axis B in parallel to the axis A of the two output gears 3, 4.

A tubular shaft 42 extends from the outer socket output gear 4 and has an outer socket 40 removably fitted in the forward end of the shaft.

A shaft 31 projecting from the inner socket output gear 3 coaxially therewith rotatably extends through a bore 41 which extends through the outer socket output gear 4 and the shaft 42 thereof coaxially therewith. An inner socket holding tube 32 extends from the forward end of the shaft 31.

An inner socket 30 is fitted in the holding tube 32 as by splining so as to be slidable on and rotatable with the tube.

The inner socket 30 is biased to project from the tube 32 by a spring 33 accommodated in the tube 32 and is prevented from projecting by a retaining stepped portion 43 formed on the outer socket 40.

The outer socket 40 is formed with a nut engaging portion 44, while the inner socket 30 has a bolt tip engaging portion 34.

An ejector pin 7 is inserted through the inner socket output gear 3 and the shaft 31 thereof axially slidably. The ejector pin 7 has a knocking head 71 at its forward end and a finger hook 72 at its base end.

The ejector pin 7 is biased forward by a spring 73 and has its forward-end knocking head 71 positioned in the inner socket 30. The finger hook 72 at the pin base end is accommodated in a cavity 35 formed in the inner socket output gear 3.

When a nut 92 is tightened up on a torque-controlled bolt 9, a tip 91 broken off the bolt and remaining in the inner socket 30 is forced out from the socket by the ejector pin 7. Stated more specifically, the ejector pin 7 is retracted by pulling the finger hook 72 with the finger after the bolt tip 91 has been broken off, and the hook is then released from the finger, whereupon the ejector pin 7 is forced forward by the restoring force of the spring 73, consequently causing the head 71 to knock the tip 91 out of the inner socket 30.

Figure 5:
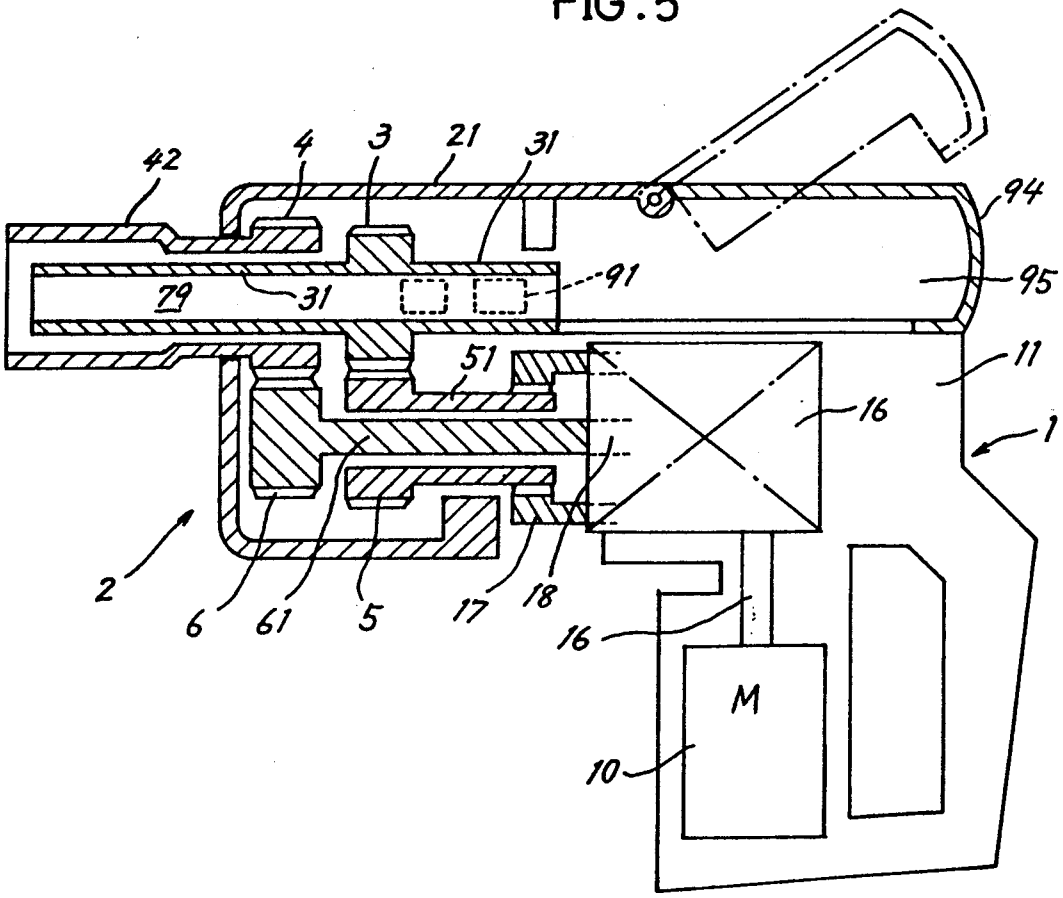
FIG. 5 is a sectional view of another embodiment.
Figure 6:
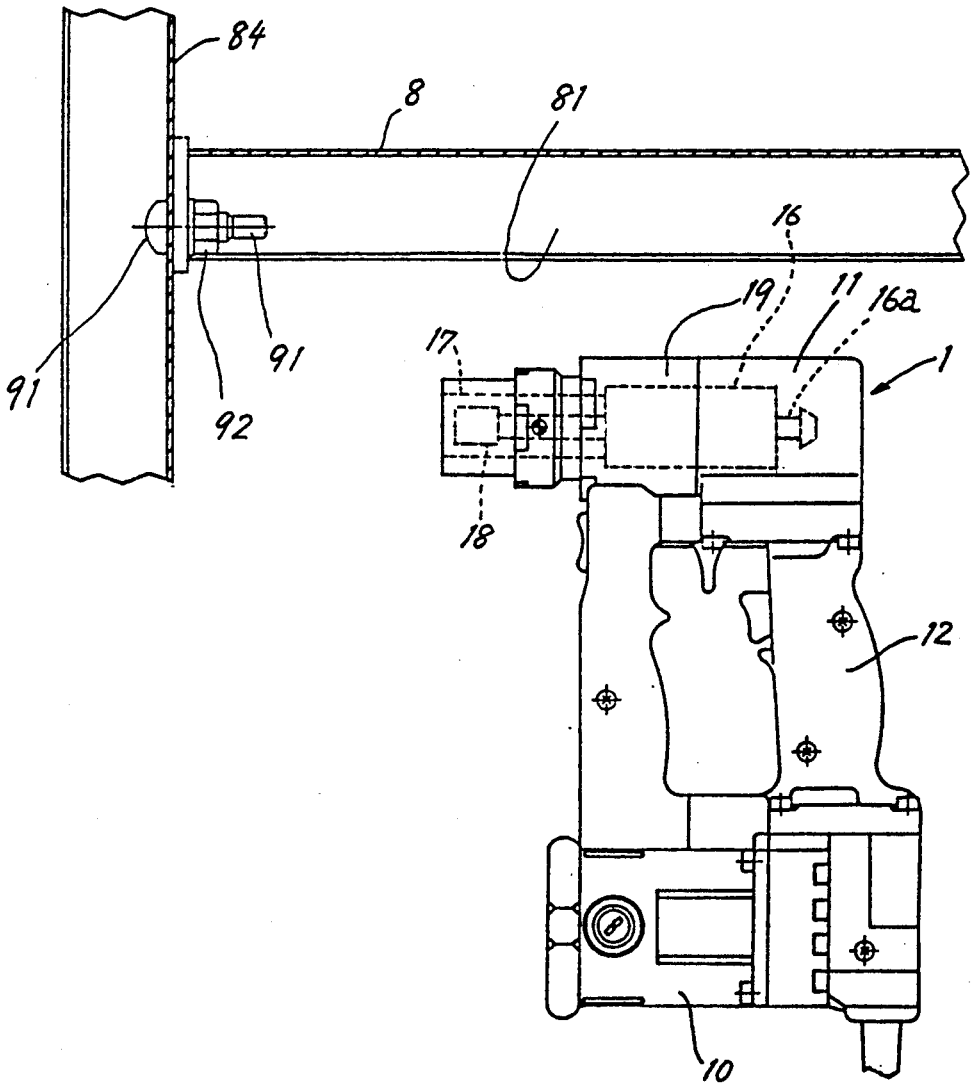
FIG.6 PRIOR ART
FIG. 6 is a front view of a conventional power tightening device.
Figure 7:
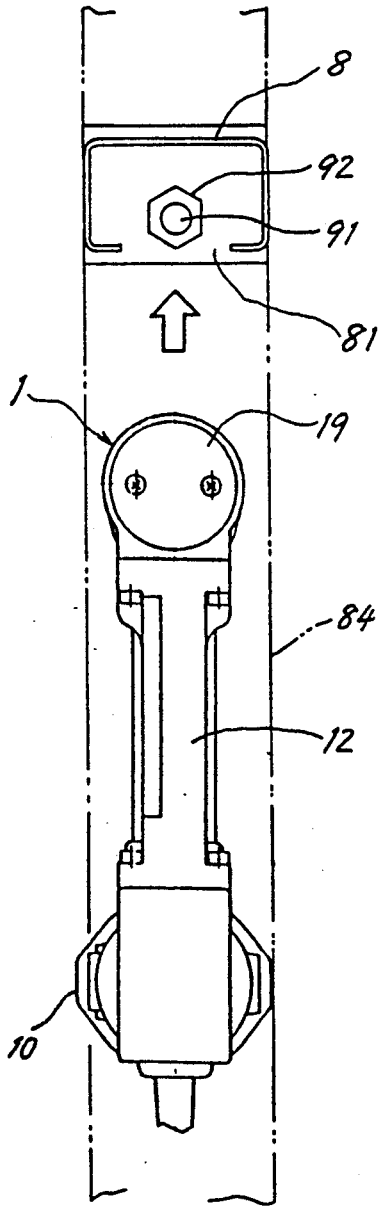
FIG 7. PRIOR ART
FIG. 7 is a side elevation of the conventional power tightening device.

FIG. 5 shows another embodiment, in which a through bore 79 extends through the inner socket output gear 3 and the shaft 31 thereof coaxially therewith. The tip 91 broken off the bolt 9 is allowed to pass through the bore 79 and led out of a rear-end opening of the bore 79 into a collecting chamber 95 provided at a rear portion of the tightening device.

This embodiment eliminates the need to discharge tips every time the tip is broken off, permitting a continual tightening operation and assuring improved safety when the work is done at high locations. The ejector pin and the spring for biasing the pin forward can be dispensed with. The tips broken off are temporarily accommodated in the collecting chamber 95 and further collected by opening a closure 94 of the chamber 95.

The inner socket input gear 5 has a tubular shaft 51 extending rearward therefrom on its axis. The shaft 51 has at its rear end an engaging portion 53 engageable with an outer socket which is fitted to an output shaft 17 of a known tightening device 1.

The outer socket input gear 6 has a shaft 61 projecting rearward therefrom on its axis and rotatably extending through the tubular shaft 51. The rear end of the shaft 61 projecting beyond the shaft 51 is provided with an engaging portion 62 which is engageable with an inner socket fitted to another output shaft 18 of the known power tightening device 1.

The housing 21 has a grip 22 projecting therefrom in a plane including the axis A of the output gears 3, 4 and the axis B of the input gears 5, 6.

The tightening device 2 of the present invention has such a simple shape that the outer socket output gear 4 and the inner socket output gear 3 are arranged on the axis of the outer socket 40 and the inner socket 30. This arrangement makes it possible to give a reduced pitch diameter to these gears and to assure the gears of required strength insofar as the module of the gears is appropriate, consequently giving a reduced size to the portion of the housing 21 covering the output gears 3, 4, i.e., a head portion 21*a* around an extension of axis of the sockets 30, 40.

Nuts are tightened on torque-controlled bolts by the device 2 of the invention in the manner to be described below.

Figure 2:
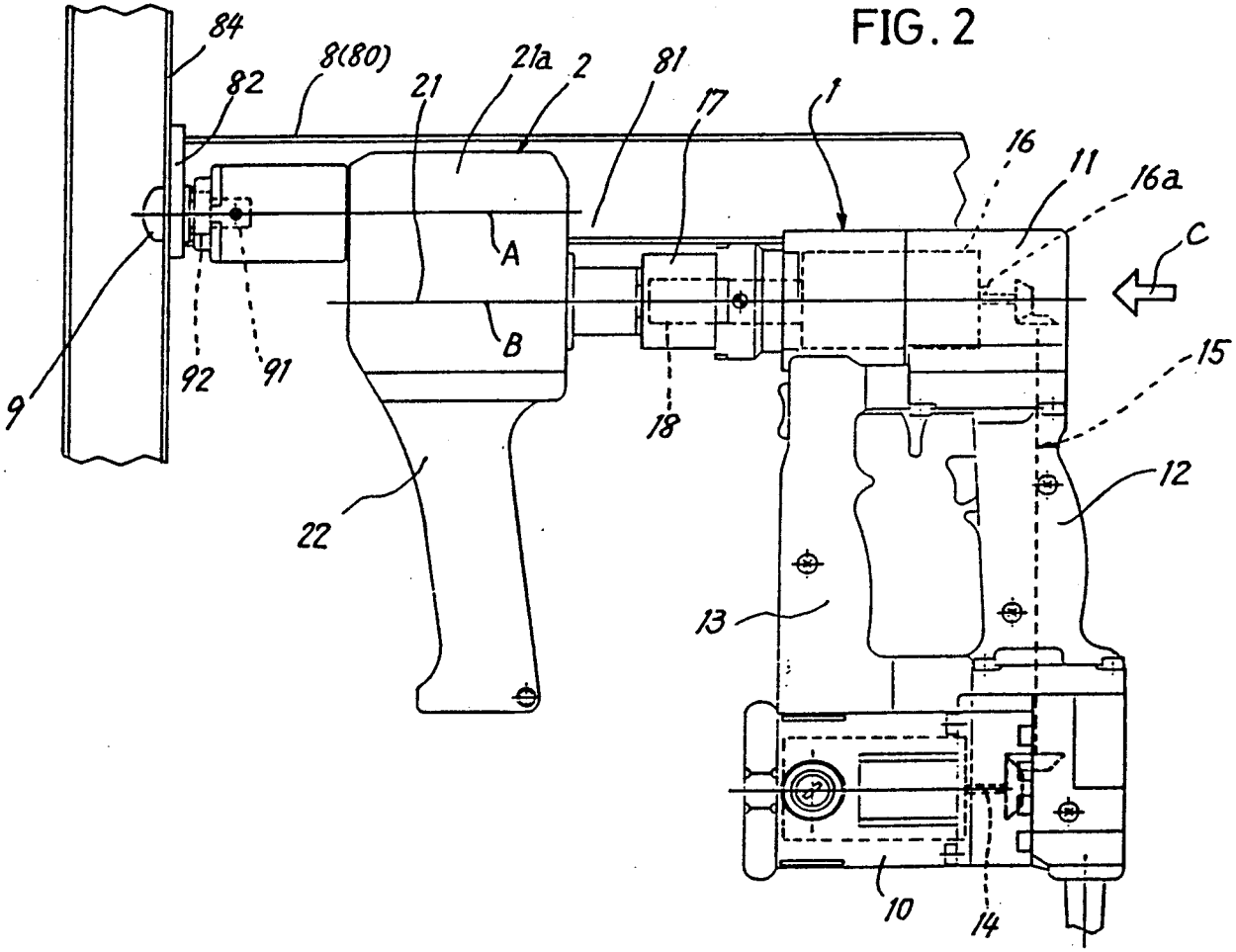
FIG. 2 is a front view showing the tightening device in use.
Figure 3:
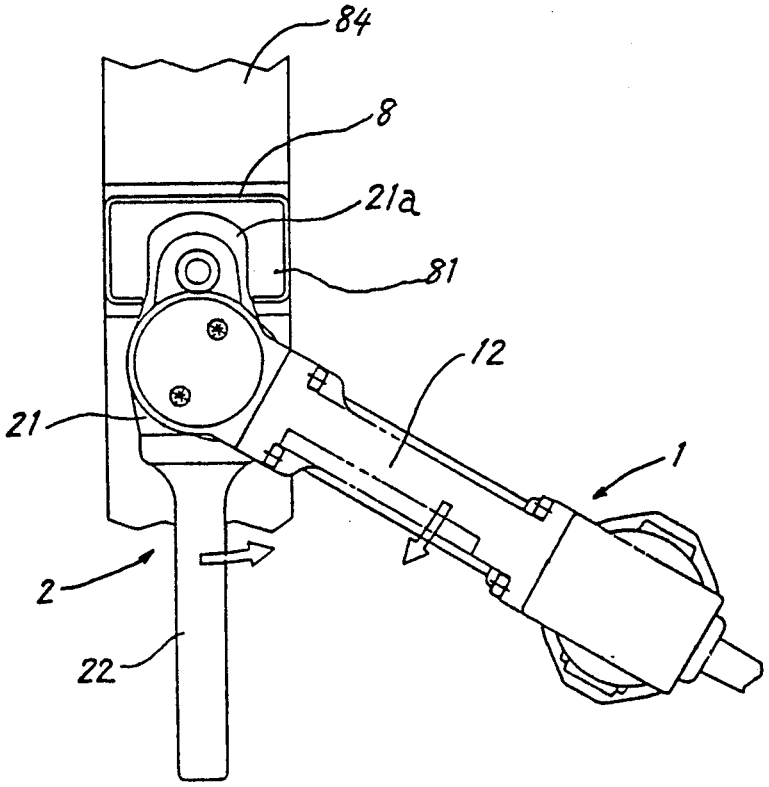
FIG. 3 is a right side elevation showing the tightening device in use.

As shown in FIGS. 2 and 3, one end of a horizontal beam in the form of a channel member 8 is closed with an end plate 82, which is placed on a vertical column 84. A torque-controlled bolt 9 is inserted through the end plate 82 and a wall of the vertical column. The tightening device 2 of the invention is used as coupled to the conventional power tightening device 1 for tightening a nut 92 on the bolt 9 within the groove 81 of the horizontal beam.

The conventional tightening device 1 has a differential reduction mechanism 16 comprising a multiplicity of planetary gears in combination and housed in a case 11, and a motor 10 disposed in parallel to the case 11. The case and the motor are connected together by a handle 12 and an auxiliary handle 13.

The planetary gear mechanism 16 has an input shaft 16*a* coupled to the shaft 14 of the motor by a train of bevel gears 15, an output shaft 17 provided with an outer socket, and another output shaft 18 provided with an inner socket arranged concentrically with the outer socket.

When the power tightening device 1 is used singly, the tip 91 of the bolt 9 is fitted into the inner socket, and the nut 92 into the outer socket.

The input tubular shaft 51 and shaft 61 of the tightening device 2 of the invention are engaged respectively with the outer socket and inner socket of the known power tightening device 1. Next, the nut is fitted into the outer socket 40 of the device 2, the bolt tip 91 is fitted into the inner socket 30 thereof, and the power device 1 is then driven.

The reduction ratio of the outer socket input and output gears 4, 6 and the reduction ratio of the inner socket input and output gears 3, 5 are each 1. If the transmission of power involves no loss, the moment of reaction occurring in the device 2 and that in the device 1 are of the same magnitude but opposite in the direction of rotation.

When the reaction moment in the device 1 and the reaction moment in the device 2 are thus of the same magnitude and opposite in rotational direction, the grip 22 of the device 2 and the handle 13 of the device 1 can be held by the respective hands to support the devices with good stability free of the likelihood that the two hands will be forcibly turned in the same direction.

If the housing 21 of the device 2 is adapted to partly bear against the case 11 of the device 1, the overall assembly can be prevented from rotation even when the grip 22 of the device 2 is not held by the worker.

The head portion 21*a* of the tightening device can be made smaller in corresponding relation with a reduction in the size of the output gears.

Figure 4:
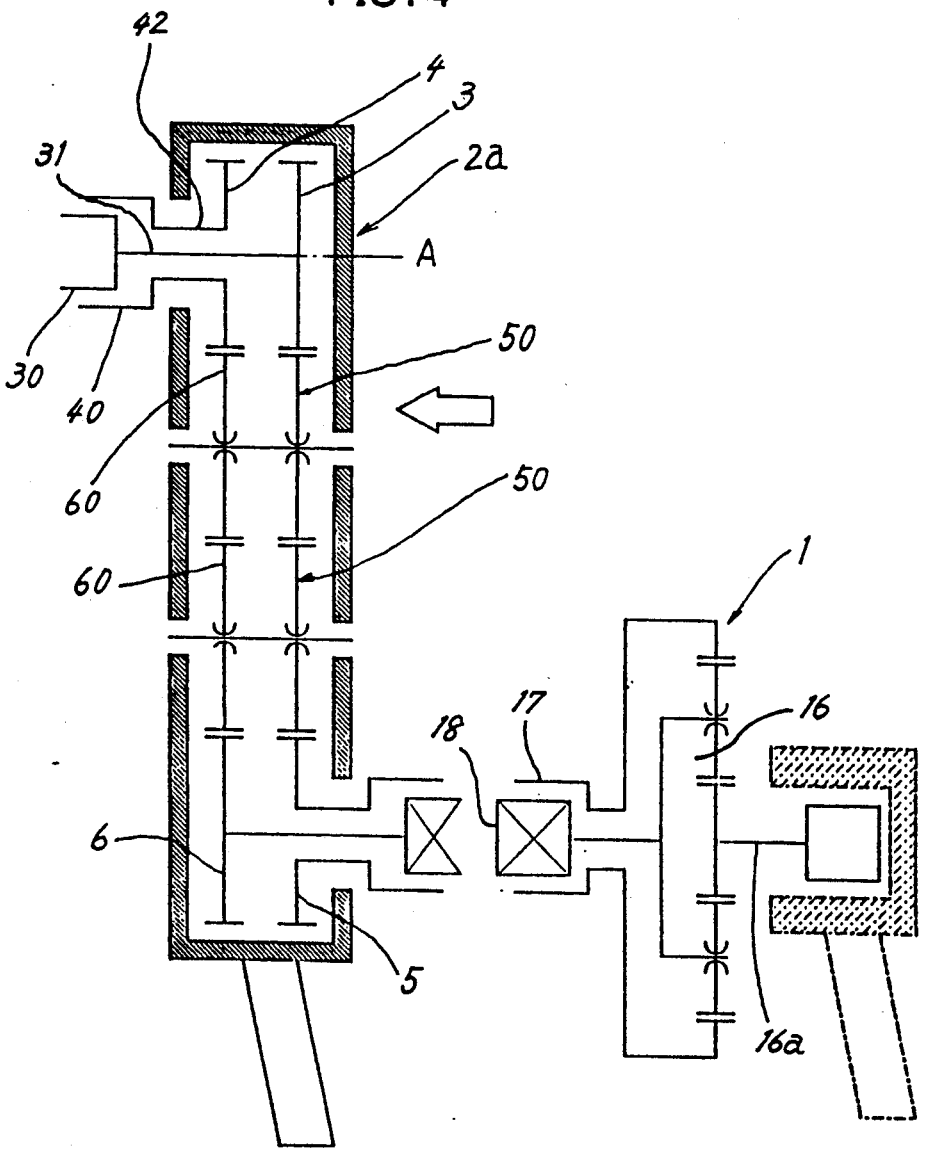
FIG. 4 is a diagram of another embodiment.

FIG. 4 shows another embodiment, i.e., a tightening device 2*a*, in which a plurality of idle gears 50 are interposed between the inner socket output gear 3 and the inner socket input gear 5, and a plurality of idle gears 60 are provided between the outer socket output gear 4 and the outer socket input gear 6.

20 With this embodiment, the output axis A of the device 2*a* is disposed in parallel to the output shafts of the power tightening device 1 at a larger distance therefrom than in the foregoing embodiment for power transmission. Accordingly, even if the torque-controlled bolt to be handled is positioned in a remote inner portion of a narrow space, the nut can tightened up on the bolt.

Although the tightening device 2 is used as removably attached to the power tightening device 1 when required, the device 2 can alternatively be assembled with the power device 1 as seen in FIG. 5. In this case, the output shaft 17 of the device 1 is connected to the tubular shaft 51 of the device 2, and the other output shaft 18 to the shaft 61. Further alternatively, the case 11 of the power device 1 may be made integral with the housing 21 of the device 2.

In other words, a drive assembly and an output assembly are accommodated in a single housing, the drive assembly including the motor 10 and the differential reduction mechanism 16, the output assembly including the output gears 3, 4, input gears 5, 6, inner socket 30 and outer socket 40.

As already described, the housing 21 of the tightening device 2 embodying the invention has accommodated therein output gears 3, 4 arranged coaxially for driving inner and outer sockets 30, 40, and includes a head portion 21*a* which covers these output gears 3, 4 and which can be diminished in size in accordance with a reduction in the size of the output gears. Although the sockets of the conventional device are not insertable into narrow spaces when singly used, work can be done in such spaces with use of the present device.

The device of the present invention is not limited to the foregoing embodiments in construction but can be modified variously within the scope of the invention as defined in the appended claims.

What is claimed is:

1. A device for tightening up a nut on a torque-controlled bolt comprising:

an inner socket first output gear rotatably disposed within a housing, an outer socket second output gear rotatably disposed coaxially with the first output gear, an inner socket first input gear rotatably disposed on an axis parallel to the axis of the first and second output gears and meshing with the first output gear, and an outer socket second input gear rotatably disposed coaxially with the first input gear and meshing with the second output gear, the first and second output gears respectively having shafts projecting therefrom in the form of concentric circles to provide socket fitting portions at outer ends of the respective shafts, the first and second input gears respectively having shafts projecting therefrom in the form of concentric circles to provide engaging portions at outer ends of the respective shafts for connection to output shafts of a power tightening device.

2. A device as defined in claim 1 wherein a bore extends through the first output gear and the shaft projecting therefrom, and an ejector pin is slidably inserted through the bore, the ejector pin having a head at a front end thereof and a finger hook at a rear end thereof and being biased forward by a spring.

3. A device as defined in claim 1 wherein a bore extends through the first output gear and the shaft projecting therefrom, and a tip broken off the torque-controlled bolt by tightening up the nut on the bolt is passed through the bore and discharged rearward.

4. A device as defined in claim 3 wherein the housing has a collecting chamber in communication with a rear opening of the bore for accommodating the tip broken off.

5. A device as defined in claim 1 wherein idle gears are arranged between the first output gear and the first input gear and between the second output gear and the second input gear to position the axis of the first and second output gears at a large distance from the axis of the first and second input gears.

6. A device as defined in claim 1 wherein the first and second input gears are connected to two output shafts of a power tightening device having a differential reduction mechanism incorporated therein.

7. A device as defined in claim 6 wherein the housing is integral with a case of the power tightening device.

* * * * *